US007568699B2

(12) United States Patent
O'Neill

(10) Patent No.: US 7,568,699 B2
(45) Date of Patent: Aug. 4, 2009

(54) BOARD GAME AND METHOD OF PLAYING THEREOF

(76) Inventor: John Edward O'Neill, 3375 Alma St. #374, Palo Alto, CA (US) 94306

( * ) Notice: Subject to any disclaimer, the term of this patent is extended or adjusted under 35 U.S.C. 154(b) by 0 days.

(21) Appl. No.: 10/821,754

(22) Filed: Apr. 9, 2004

(65) Prior Publication Data

US 2004/0201171 A1 Oct. 14, 2004

Related U.S. Application Data

(60) Provisional application No. 60/462,494, filed on Apr. 11, 2003.

(51) Int. Cl.
*A63F 3/00* (2006.01)

(52) U.S. Cl. ..... 273/260; 273/288

(58) Field of Classification Search ..... 273/260, 273/288, 289, 290; D21/388
See application file for complete search history.

(56) References Cited

U.S. PATENT DOCUMENTS

| | | | | | |
|---|---|---|---|---|---|
| 1,578,554 | A | | 3/1926 | Seligman | |
| 3,274,727 | A | | 9/1966 | Zander | 46/16 |
| 3,406,975 | A | | 10/1968 | Berger | 273/136 |
| 3,610,626 | A | * | 10/1971 | Nolte | 273/261 |
| 3,951,411 | A | * | 4/1976 | Hill et al. | 273/243 |
| 3,973,775 | A | * | 8/1976 | Bolan et al. | 273/253 |
| 4,046,381 | A | * | 9/1977 | Comeaux | 273/249 |
| 4,093,237 | A | * | 6/1978 | Weiss | 273/260 |
| 4,249,740 | A | * | 2/1981 | Cheney et al. | 273/260 |
| 4,306,724 | A | * | 12/1981 | Brzezinski et al. | 273/243 |
| 4,341,386 | A | | 7/1982 | Kleva | 273/239 |
| 4,625,971 | A | | 12/1986 | Ferguson | 273/272 |
| 4,645,209 | A | | 2/1987 | Goulter et al. | 273/271 |
| 4,842,281 | A | | 6/1989 | Turner | 273/256 |
| 5,100,149 | A | | 3/1992 | Olfman et al. | 273/241 |
| 5,195,750 | A | | 3/1993 | Courialis | 273/241 |
| 5,556,099 | A | | 9/1996 | Mardirosian | 273/241 |
| 6,120,029 | A | * | 9/2000 | Carmichael et al. | 273/260 |
| 6,419,228 | B1 | | 7/2002 | Egli et al. | 273/236 |
| D479,283 | S | | 9/2003 | Heil | |
| D483,414 | S | | 12/2003 | Wilson, Sr. | |
| 6,669,196 | B1 | | 12/2003 | Washko | |
| 6,669,197 | B1 | | 12/2003 | Lund et al. | |
| 6,688,596 | B2 | | 2/2004 | Nielsen | |
| 6,692,002 | B2 | | 2/2004 | Kummer | |
| 6,817,613 | B2 | * | 11/2004 | Hasek | 273/256 |
| 2003/0094759 | A1 | | 5/2003 | Niedner et al. | 273/255 |
| 2004/0201171 | A1 | | 10/2004 | O'Neill | 273/260 |
| 2005/0017447 | A1 | | 1/2005 | Geshwind | 273/236 |

FOREIGN PATENT DOCUMENTS

| | | |
|---|---|---|
| GB | 2202453 A | 9/1988 |

* cited by examiner

*Primary Examiner*—Vishu K. Menditatta
(74) *Attorney, Agent, or Firm*—Haverstock & Owens LLP

(57) ABSTRACT

A game board is divided into squares, and is partitioned into an inner play area and an outer play area that surrounds the inner play area. The outer play area acts as a game engine in that it controls the functionality of one or more game pieces within the inner play area. The inner play area preferably comprises a 6×6 array of squares, and the outer play area includes a perimeter of squares which surround the inner play area. A position of a game piece traversing the outer play area determines functionality of certain game pieces positioned within the inner play area. Functionality of these game pieces in the inner play area are in a constant state of change relative to the changes of position of the game piece in the outer play area.

13 Claims, 13 Drawing Sheets

100

| | | | | | | | |
|---|---|---|---|---|---|---|---|
| 37 | 38 | 39 | 40 | 41 | 42 | 43 | 44 |
| 64 | 1 | 2 | 3 | 16 | 17 | 10 | 45 |
| 63 | 8 | 9 | 4 | 15 | 18 | 11 | 46 |
| 62 | 7 | 6 | 5 | 14 | 13 | 12 | 47 |
| 61 | 21 | 22 | 23 | 32 | 33 | 34 | 48 |
| 60 | 20 | 27 | 24 | 31 | 36 | 35 | 49 |
| 59 | 19 | 26 | 25 | 30 | 29 | 28 | 50 |
| 58 | 57 | 56 | 55 | 54 | 53 | 52 | 51 |

110

120

*Fig. 1*

BOARD GAME AND METHOD OF PLAYING THEREOF

CROSS REFERENCE TO RELATED APPLICATIONS

This application claims priority of U.S. provisional application, Ser. No. 60/462,494, filed Apr. 11, 2003, and entitled Admcadiam Paradice, by this same inventor. This application incorporates U.S. provisional application, Ser. No. 60/462,494 in its entirety by reference.

FIELD OF THE INVENTION

The present invention relates to the field of games. More particularly, the present invention relates to the field of board games and a method of playing thereof.

BACKGROUND OF THE INVENTION

Board games are known for providing challenge and enjoyment to users. New games are desired.

SUMMARY OF THE INVENTION

A game board is divided into squares arranged as rows and columns, and is partitioned into an inner play area and an outer play area that surrounds the inner play area. The outer play area acts as a game engine in that it controls the functionality of one or more game pieces within the inner play area. The inner play area preferably comprises a 6×6 array of squares, and the outer play area includes a perimeter of squares which surround the inner play area. A position of a game piece traversing the outer play area determines functionality of certain game pieces positioned within the inner play area. Functionality of these game pieces in the inner play area are in a constant state of change relative to the changes of position of the game piece in the outer play area The inner play area represents an ecosystem comprising different forests, each forest supporting a forest spirit of a different color and a Human Being observing the world from a different point of view. The inner play area is preferably divided into four quadrants. Each quadrant defines a specific type of forest, each forest with it's own type of tree. In the preferred embodiment, the four types of trees include deciduous trees, coniferous trees, palm trees, and rainforest trees. In the center of each quadrant is a forest spirit game piece. At the outer corner of each quadrant is a Human Being game piece.

Each game is divided into a serious of rounds. The number of rounds is predetermined and based on any number of different game objectives. Each round includes three parts. In the first part, the die is rolled and the game piece in the outer play area is moved around the outer perimeter of squares by the number rolled on the die. It is determined which of the Human Being game pieces is to function in a take mode. The remaining Human Being game pieces then function in a give mode. The Human Being game piece closest to the game piece moved in the outer play area is the Human Being game piece that functions according to the take mode. In part two of the round, a player acting according to the take mode moves the Human Being game piece functioning in the take mode. The number of moves available in the take mode is equal to the number of the rolled die in part one of the round. The player in take mode attempts to remove trees from the inner play area.

In part three of the round, a player(s) makes a number of moves also equal to the number of the rolled dice in part one of the round. A player(s) operating in the give mode makes a move by moving any one of the three Human Beings not functioning in the take mode, moving any one of the forest spirits, replacing previously taken trees onto the inner play area of the game board, moving the one Human Being functioning in the take mode if the other three Human Beings are already seeing eye-to-eye, or any combination thereof.

Once each of the modes, take and give, are played, it is determined if additional rounds are to be played. If the player operating in take mode successfully takes all trees from two different forest, then the game ends. If the player(s) operating in the give mode successfully positioned all four Human Being game pieces into a pyramid configuration, then the game ends. Otherwise, game play can continue and the die is rolled again. It is understood that alternative steps can be added, changed, or removed according to alternative methods of game play. For example, if two players are playing where they alternate each round from being in take mode to being in give mode, and vice versa, then as each new round begins, the roll of Giver and Taker are switched by the two players.

Preferably, the game board is configured to be four separate squares joined by an 'x' shaped bracket. When separated from the bracket, the four squares are joined with a top and bottom to form a box for holding the game pieces when in use. An x-rod penetrates the top and bottom to hold the box together.

BRIEF DESCRIPTION OF THE DRAWINGS

FIG. 1 illustrates a preferred embodiment of the game board used in the present invention.

DETAILED DESCRIPTION OF THE PREFERRED EMBODIMENT

Figure 2:
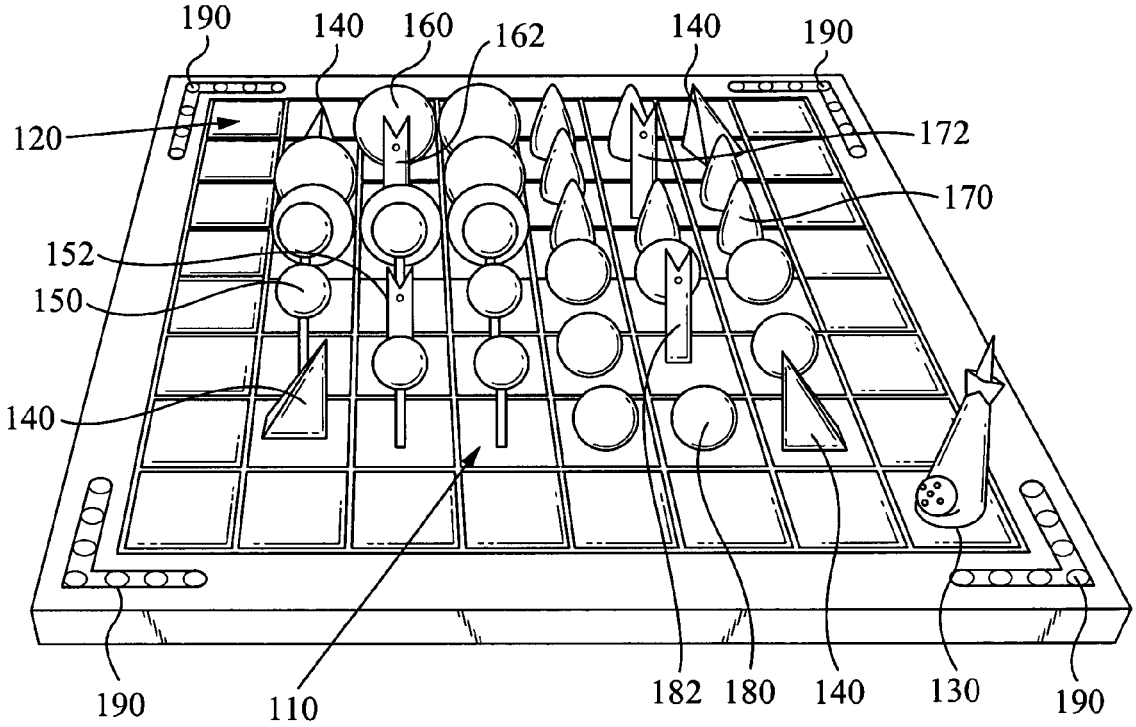
FIG. 2 illustrates the preferred starting configuration of the game pieces on the game board illustrated in FIG. 1.

A board comprises an inner playing area, referred to as Paradice, preferably comprising 36 squares placed in a 6×6 array, and an outer border around the perimeter of the inner playing area playing area, the outer border referred to as a Universe Interface and comprising 28 squares. In each quarter of the inner playing area, trees surround a life form referred to as a forest spirit. Each quarter preferably comprises seven trees of the same type and one forest spirit associated with the tree type. Four Human Beings, expressed as different Points of View, look in from each corner. An Opportunity token preferably holding a round die, occupies any square within the Universe Interface. In the preferred embodiment, the counter uses a die. It will be apparent to those of ordinary skill in the art that other means for selecting a move can be used. Examples can include a numbered spinner, a block with a different color on each face and a corresponding series of colors on the Universe Interface. Paradice is a metaphor arena for life with four different forests. Each forest supports a different forest spirit. Each forest spirit and forest initially support a different Human Being. Each Human Being initially sees Paradice from a different Point of View, i.e. is facing a different direction.

Each Human Being can respond to Opportunity in one of two ways, as a Giver and as a Taker. As a Taker, a Human Being takes trees from the board. As a Giver, a Human Being seeks to maximize the health of Paradice by reviving trees, forest spirits and forming a pyramid. The purpose of the game is to unite all of the Human Beings to see eye-to-eye, and share the values and visions developed from their different Points of View, before a Human Being acting in the Taker mode ends the game.

In the Taker mode, a Human Being moves the number of squares displayed on the die, taking off trees as it moves. In the Giver mode, a Human Being moves through the trees placing the tree displaced by its arrival in the square it came from. In both modes, a Human Being rests on the last square of its move facing the same way it began. In both modes, Human Beings can move horizontally and/or vertically, but not diagonally.

The position of the Opportunity token creates Opportunity, for both the Taker mode and the Giver mode. Opportunity revolves around Paradice continually changing which Human Being is in Taker mode. Any of the other three Human Beings which have not been deactivated can be selected to be in Giver mode. Opportunity defines the moves each Human Being can make in Taker or Giver mode. The Human Being closest to the resting place of the Opportunity token acts first as the Taker.

To determine the resting place of the Opportunity token, start by placing the Opportunity token in any square of the Universe Interface, and roll the die. Place the die in the Opportunity token with the thrown number uppermost. Move the Opportunity token around the Universe Interface the number displayed on the die. Place an indicator mask on the Human Being nearest to where the Opportunity token stops to define that particular Human Being as active in the Taker mode. In the preferred embodiment, the indicator is a mask.

Play of the game is the dialogue between the Taker and Giver as each use Opportunity. The Human Being in Taker mode acts first. The Human Being in Taker mode uses Opportunity for the pursuit of needs defined by its particular goal. One or more of the other Human Beings in Giver mode, move to unite their Points of View in order to maximize the health of Paradice.

The game is played in rounds, divided into three parts. First, the die is rolled and the Opportunity token is moved around the Universe Interface. Second, the Human Being in Taker mode moves. Third, the other Human Beings responding in Giver mode move. In Taker and Giver modes, Human Beings make use of the same Opportunity number, as determined by the rolled die. Taker mode strategy ranges from eating trees, isolating forest spirits, deactivating Human Beings in Giver mode, and ending moves strategically. Response strategy in Giver mode combines moving Human Beings together, saving forest spirits, and saving Human beings, thereby saving Paradice.

I. Components of the Game

A game board is divided into squares, and is partitioned into an inner play area and an outer control area that surrounds the inner play area. FIG. 1 illustrates a preferred embodiment of the game board used in the present invention. A game board 100 includes an 8×8 array of squares, squares 1-64. The game board 100 includes an inner play area 110 and an outer Universe Interface 120. The play area 110 is also referred to as Paradice. The outer Universe Interface 120 is also referred to as a Universe Interface. The outer Universe Interface 120 acts as a game engine in that it controls the functionality of one or more game pieces within the inner play area 110. The function of the game engine and the controls it imparts are discussed in greater detail below. The play area 110 preferably comprises a 6×6 array of squares, the squares 1-36. The outer Universe Interface 120 preferably comprises a perimeter of squares, the squares 37-64, which surround the play area 110.

A position of the Opportunity toke 130 traversing the Universe Interface squares determines attributes, including but not limited to powers and move potential, of game pieces in the play area 110. Preferably, a single token moves within the outer Universe Interface 120 to represent Opportunity. Alternatively, more than one game piece moves within the outer Universe Interface 120. The token on the Universe Interface squares can refer to other game pieces located in the play area 110. In particular, after the Opportunity token is moved, the closest Human Being is the playing piece of the Taker. Such a reference can be made be a position, color or shape of the game pieces. Attributes of game pieces in the play area 110 are in a constant state of change relative to the changes of position of the Opportunity token in the Universe Interface 120.

Paradice represents an ecosystem comprising different forests. Initially, each forest supporting a unique forest spirit. In the preferred embodiment, the forest spirits are each of a different color. Also, at the beginning of a game each forest contains a Human Being, each facing the center of the board from their respective corner.

The play area 110 is preferably divided into four quadrants. A first quadrant includes squares 1-9. A second quadrant includes squares 10-18. A third quadrant includes squares 19-27. A fourth quadrant includes squares 28-36. Perferably, each quadrant defines a specific type of forest, each forest with a unique type of tree. In the preferred embodiment, the four types of trees include deciduous trees, coniferous trees, palm trees, and rainforest trees. In the center of each quadrant is a forest spirit game piece. At the outer corner of each quadrant (squares 1, 10, 19 and 28) is a Human Being 140 game piece which starts the game facing inward toward the center of the game board 100. The orientation of each Human Being 140 is significant, as will be described in greater detail below. Game pieces initially fill the entire play area 110. All but one of the Universe Interface 120 squares are empty.

FIG. 2 illustrates the preferred starting configuration of the game pieces on the game board 100. Positions of the game pieces illustrated in FIG. 2 are referenced according to the square numbers shown in FIG. 1. For example, the Universe Interface 120 includes squares 37-64, all of which are empty except for the one square 51 in this example, which is occupied by a Opportunity token 130. The Opportunity token 130 is preferably constructed such that the die can be placed on a base portion with the top face of the die exposed to view. The play area 110 is shown with its four quadrants, each quadrant representing a forest as described above in relation to FIG. 1. A rainforest includes seven rainforest trees 160, a rainforest spirit 162, and one Human Being 140. The rainforest spirit 162 is positioned at the center of the rainforest, which corresponds to square 9 in FIG. 1. One rainforest tree 160 is positioned on each of the squares 2-8, and one Human Being 140 is positioned on the square 1. A coniferous forest includes seven coniferous trees 170, a coniferous spirit 172, and one Human Being 140. The coniferous spirit 172 is positioned at the center of the coniferous forest corresponding to square 18. One coniferous tree 170 is positioned on each of the squares 11-17, and one Human Being 140 is positioned on the square 10. A deciduous forest includes seven deciduous trees 180, a deciduous spirit 182, and one Human Being 140. The deciduous spirit 182 is positioned at the center of the deciduous forest corresponding to square 36. One deciduous tree 180 is positioned on each of the squares 29-35, and one Human Being 140 is positioned on the square 28. A palm forest includes seven palm trees 150, a palm spirit 152, and one Human Being 140. The palm spirit 152 is positioned at the center of the palm forest corresponding to square 27. One palm tree 150 is positioned on each of the squares 20-26, and one Human Being 140 is positioned on the square 19. It is understood that the relative positions of each of the forests illustrated in FIG. 2 is for exemplary purposes only, and that each forest can be initially positioned within any of the four quadrants within the play area 110. Further, the starting position of the Opportunity token 130 illustrated in FIG. 2 is for exemplary purposes only. The starting position is randomly selected by the players. The starting position of the Opportunity token 130 can be any square 37-64 within the Universe Interface 120.

There are four forest spirits, one in the center of each quadrant. Each forest has a unique forest spirit, preferably denoted by color. At the beginning of each game it is determined which forest spirit belongs to each forest. The forest spirit can only be supported by trees of its forest type. The forest spirits thrive on the health of its forest. For a forest spirit to remain standing it must have at least one tree from its forest in a square adjacent to the square it occupies. A square is adjacent another if it meets the side or corners of the other square. A forest spirit or Human Being is considered active, or alive, if it remains standing. A forest spirit or Human Being is considered in-active, or dead, when it is placed on its side. A tree is considered active, or alive, if it remains standing on one of the play area squares. A tree is considered in-active, or dead, if it is removed from the board.

There are four Human Beings 140. At the onset of the game each Human Being 140 is looking inward, towards the center of the game board. If the sides of the board are considered facing north, south, east and west one points north-west, another north-east, south-west, and south-east. Each Human Being 140 remains pointing in its same initial direction through out the game, unless a move is specifically made to rotate the orientation of the game piece. In the absence of such a rotational move, the human being 140 maintains its orientation, no matter into which square it is moved. So, the Human Being 140 that begins pointing north-west, remains pointing north-west throughout the game, unless it is specifically rotated otherwise.

Figure 12:
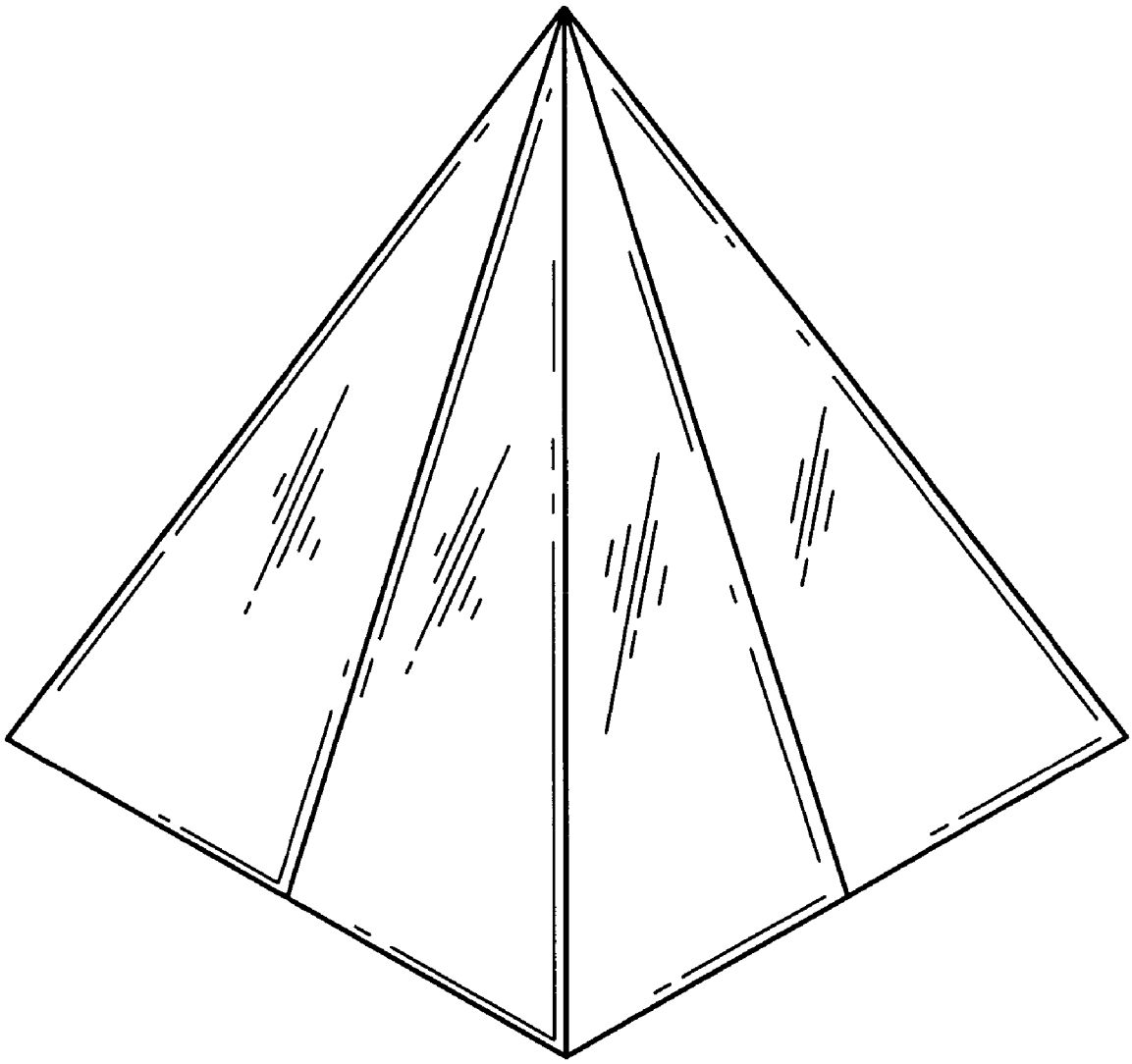
FIG. 12 illustrates a perspective view of four Human Beings seeing eye-to-eye to form a pyramid.
Figure 13:
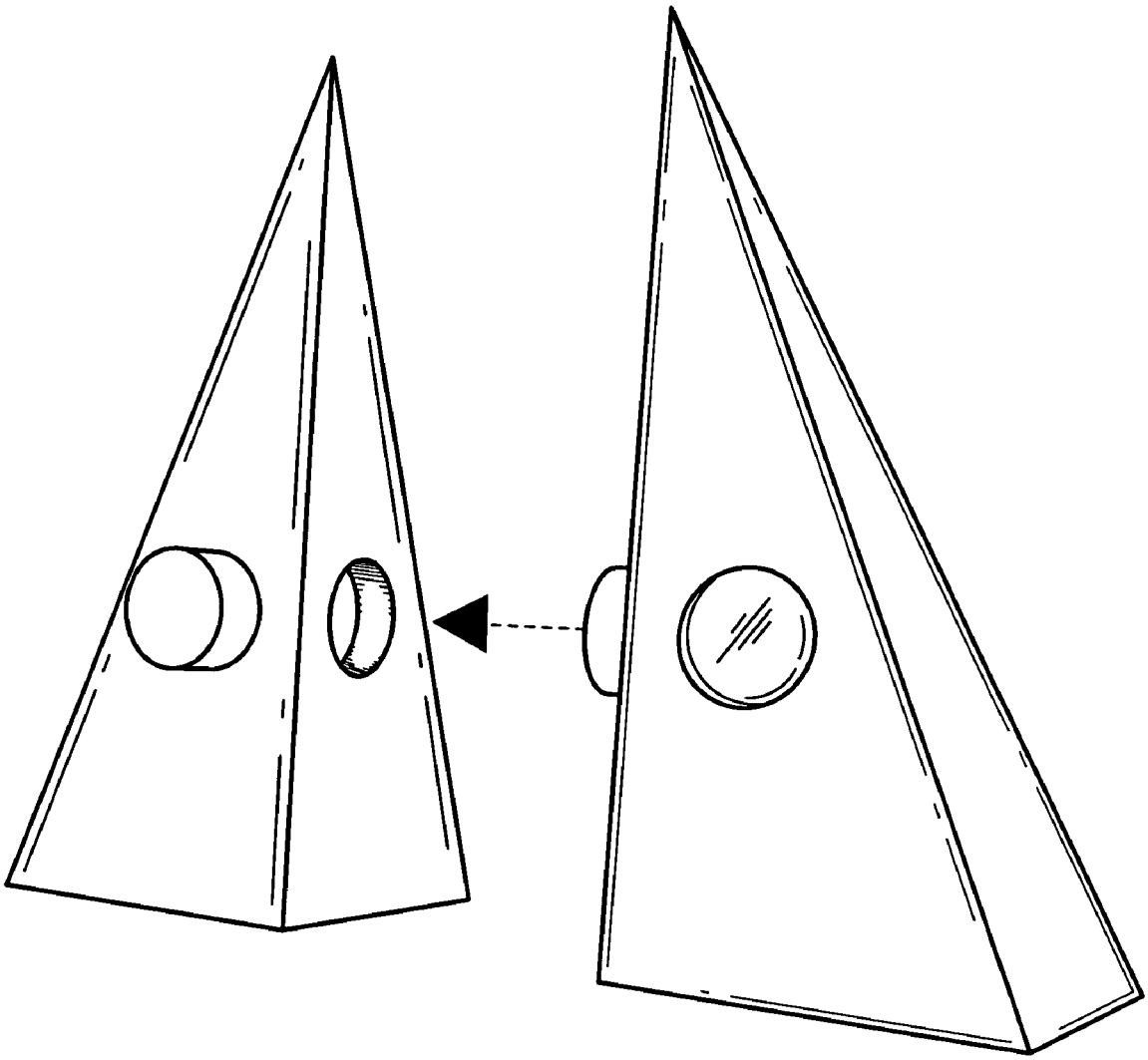
FIG. 13 illustrates two Human Beings including the two eyes on each Human Being, as the two Human Beings see eye-to-eye.
Figure 14:
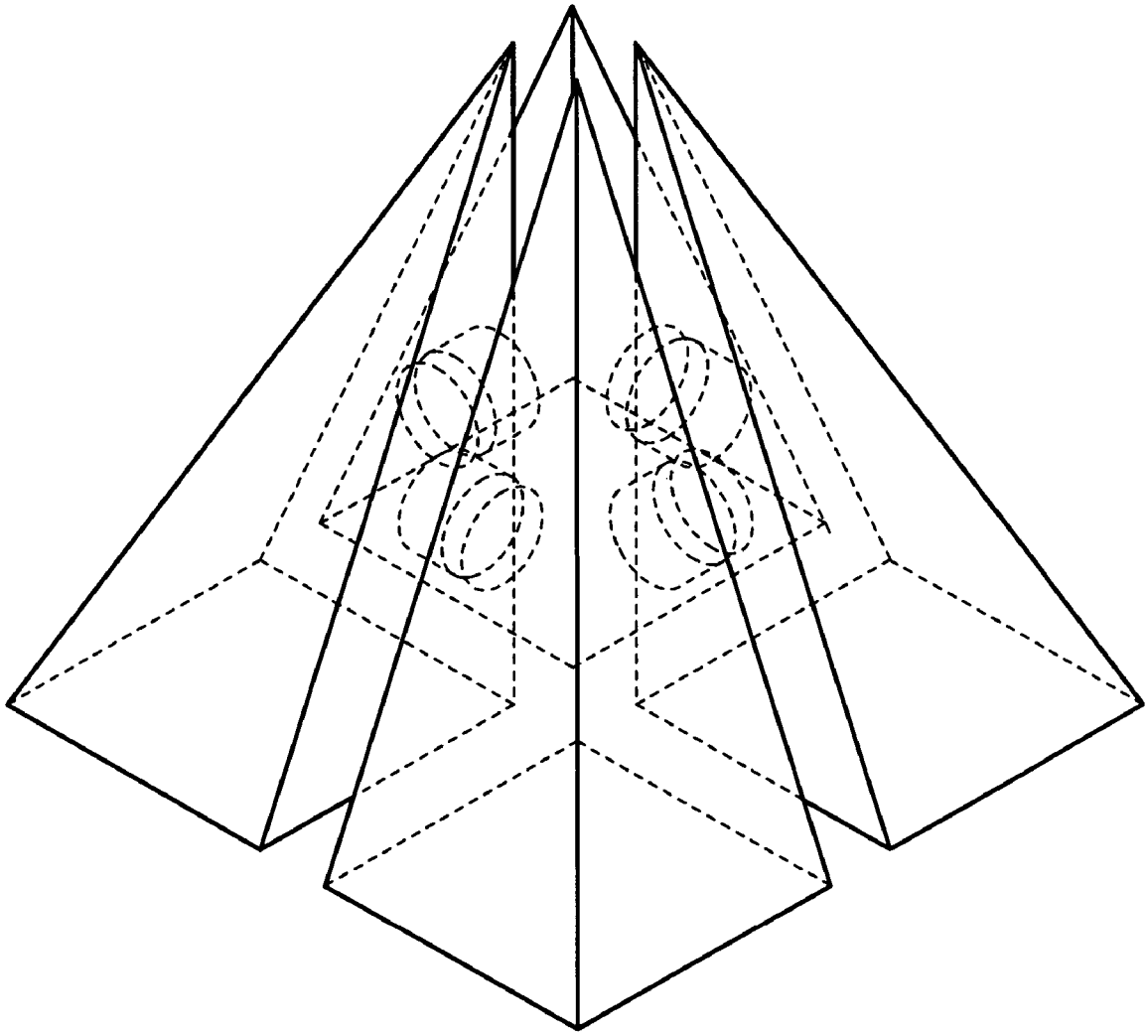
FIG. 14 illustrates a perspective view of the four Human Beings, and the relative positions of the two eyes on each Human Being, as the Human Beings interlock to form the pyramid illustrated in FIG. 12.

Each Human Being 140 can operate in one of two modes. The mode can change from turn to turn. In a Taker mode, the goal is primarily to take trees. In a Giver mode the goal is to position all Human Beings 140 together such that they see "eye-to-eye". Each Human Being 140 is configured to include a "front" and a "back". In the preferred embodiment, when all four Human Beings 140 are positioned "eye to eye", they form a pyramid. The top point of each Human Being 140 is considered its head, the two vertical facing sides are considered its front, and the two downward sloping sides are considered its back. When the four Human Beings 140 form the pyramid, the back, or downward sloping sides, form the outer faces of the pyramid, as illustrated in FIG. 12. Each Human Being 140 is considered to have two eyes, one eye on each of the two front, or vertical facing, sides. When a front side of two adjacent Human Beings 140 face each other, the two Human Beings 140 are considered to be eye-to-eye. The two Human Beings 140 are not considered to be eye-to-eye, when a front side is facing a back side. When a Human Being 140 is seeing eye-to-eye the game pieces are considered to be interlocked. For each Human Being 140, one eye extends outwardly from the surface of one front side and the other eye is concave to receive the extending eye from another Human Being 140, as illustrated in FIG. 14. FIG. 13 illustrates a perspective view of the four Human Beings, and the relative positions of the two eyes on each Human Being, as the Human Beings interlock to form the pyramid illustrated in FIG. 12. The starting orientation of each Human Being 140 is looking inward toward the center of the game board 100.

The Opportunity token 130 is the dice holder and is preferably the only game piece that moves in the Universe Interface 120. The die can be removed and rolled, then replaced in the Opportunity token 130 with the thrown number upword and visible. The Opportunity token 130 never enters Paradice, the play area 110.

II. Methods of Playing the Game

The object of the game for the Giver is to join all four Human Beings 140 together, forming a pyramid, before two complete forests in Paradice are taken. In a first method of playing the game, the players choose who will play the Giver and who the Taker. To start, the Opportunity token 130 is placed on any square in the Interface 120. The game is played in rounds, each round having three parts. In part 1, one player rolls the die, and places it, rolled number up, in the Opportunity token 130. This number is the Opportunity, or the Opportunity number, for the round, to which both players respond, one as Taker and one as Giver in the second and third parts of the round, respectively. Any player moves the Opportunity token 130 clockwise around the Universe Interface 120, where the number of squares moved equals the Opportunity number. The Human Being 140 nearest the resting square of the Opportunity token 130 becomes the play piece for the Taker. A mask is placed on this play piece, thereby masking the human being 140. The "distance" from the Opportunity token 130 to a Human Being 140 is counted using only vertical and horizontal steps, not diagonals. To start the game, if the Opportunity token 130 stops equidistant between two, or three, Human Beings 140, then the Taker chooses which Human Being 140 to put the mask on, which thereby becomes the play piece of the Taker. Alternatively, the direction of moving the Opportunity token 130 can reverse upon achieving a particular event, such as a selected number on the die, or a given countdown time on a timer, among others.

In part 2, the Taker responds to the Opportunity. The Taker always plays the Human Being 140 wearing the mask. The primary objective of the Taker is to remove trees from the game board 100. Moves are taken one square horizontally or vertically, but not diagonally, for each digit of the number displayed by the die in the Opportunity token. At each move, if the Taker moves through or onto a square occupied by a tree, the Taker removes that tree from the game board 100. Each move decreases the value of the Opportunity number by one. When the player in Take mode has used up the available number of moves, as represented by the Opportunity number, the Taker is done and part 2 of the round is completed. When the square occupied by a forest spirit is no longer adjacent a square with a tree from its forest, that forest spirit is in-active and laid down on its square.

In part 3, the Giver responds to the same Opportunity as used by the Taker. As such, the Giver has the same number of moves available as did the Taker. The Giver can move any of the three un-masked Human Beings 140 or forest spirits 152, 162, 172, 182 as many moves as Opportunity provides. Moving any piece one square uses one digit of the number displayed by the die in the Opportunity token 130. As the Giver moves any piece through the forests one square at a time, trees and other playing pieces are displaced to the square from which the play piece of the Giver was moved. For example, referring to FIG. 1, if an un-masked Human Being 140 occupies square 19 and a palm tree 150 occupies square 26, and the Giver moves the Human Being 140 from square 19 to square 26, the palm tree 150 is displaced from square 26 to square 19. Moves are taken horizontally or vertically, but not diagonally, for each digit of Opportunity. The Giver achieves the ability to give trees back to their forest when any of the unmasked Human Beings 140 are moved to fit together eye-to-eye. When two Human Beings 140 see eye-to-eye, subsequent moves can be used by the Giver to replace one tree on the play area 110, and restore (re-activate) forest spirits and Human Beings 140. When three Human Beings 140 see eye-to-eye, subsequent moves can be used by the Giver to replace two trees for each move remaining from the number on the die in the Opportunity token 130. To restore a forest spirit, at least one tree from the corresponding forest must be placed into a square adjacent that forest spirit. Upon restoring such a tree, the forest spirit can be uprighted in the square where it was standing before it was laid down. Preferably, one digit of the Opportunity number is used to replace the tree, but the deactivated forest spirit and the deactivated Human Being are set upright for no extra cost. In an alternative embodiment, raising a deactivated forest spirit uses one move from the Opportunity number. In yet another alternative embodiment, raising a deactivated human being also uses one count of the die. When the Giver has used up the available number of moves, as represented by the Opportunity number, the Giver is done and part 3 is completed. At this point, a new round is started and the die is rolled again. Within each round, the Taker always plays before the Giver.

In subsequent rounds, if the Opportunity token 130 lands nearer to a different Human Being 140 than the one wearing the mask in the previous round, the mask passes to the closer Human Being 140. The closer Human Being 140, now wearing the mask, becomes the Human Being 140 playing piece that the Taker uses. If the Opportunity token 130 lands equidistant between the current Human Being 140 wearing the mask, in other words the current playing piece of the Taker, and another human being 140, then the current Human Being 140 the Taker chooses which gets the mask. If two un-masked Human Beings 140, that is two Human Beings 140 in the Giver mode, are equidistant to the Opportunity token 130, and closer to the Opportunity token 130 than the current Human Being 140 wearing the mask, the Taker chooses which one of the two un-maked Human Beings 140 will receive the mask on.

The Taker always moves the Human Being 140 wearing the mask, with the objective to take as many trees as possible and avoid being stopped by the other players, the un-masked Human Beings 140. The masked Human Being 140 must face the same direction at the end of a move as it did at the start, unless a move is used to turn the masked Human Being 140. Trees are taken off the game play area 110 by the masked Human Being 140 moving through and onto a square occupied by a tree. Moving the masked Human Being 140 onto a square occupied by an un-masked Human Being 140, or onto a square occupied by a forest spirit 152, 162, 172, 182 displaces it to the square from which the masked Human Being 140 moved from.

Since it is an objective of the Giver to stop the Taker from taking trees, the Taker can protect itself by blocking the Giver from doing this. The Taker can also protect itself from being pulled into a pyramid of Human Beings 140 by the Giver. Moves the Taker can make to protect itself include, but are not limited to, taking all the trees surrounding a forest spirit, thereby allowing the Taker to lay down the forest spirit, and also to lay down an un-masked human being 140 nearest the downed forest spirit. Another move includes chasing a forest spirit out of its supporting forest by moving the masked Human Being 140 onto the square occupied by the forest spirit, and thereby displacing the forest spirit to the square from which the masked human being 140 moved from. If after the forest spirit is displaced, there are no longer any trees of its forest touching the displaced forest spirit, than the forest spirit has been separated from its forest. This allows the Taker to lay down the displaced forest spirit and also to lay down an un-masked Human Being 140 that is nearest to the downed forest spirit. Another move available to the Taker includes breaking up groups of un-masked Human Beings 140 positioned eye-to-eye by moving the masked Human Being 140 onto a square occupied by one of the un-masked Human Beings 140, thereby displacing the un-masked Human Being 140 to the square from which the masked Human Being 140 moved from. Several un-masked Human Beings 140 can be displaced in a single turn, if a sufficient number of moves are available. The Taker can use any combination of these moves within a given turn.

Masked Human Beings 140, which are in the Taker mode, take trees. Any tree occupying a square on which the masked Human Being 140 lands is taken and removed from the play area 110. A goal of the Taker is to take trees, which in turn will deactivate forest spirits. The masked Human Beings 140 cannot directly deactivate a forest spirit. The masked Human Being 140 can only deactivate a forest spirit indirectly by stripping away the forest for that forest spirit.

The forest spirits are the sustaining energy for the Human Beings. When a forest spirit is deactivated, a Human Being is also deactivated. When all of the trees from a forest are taken, or a tree from its forest is no longer adjacent the square of the forest spirit, that forest spirit is deactivated, and is laid on its side. The deactivated forest spirit can be laid down in any direction. When this happens, the nearest un-masked human being, that is the nearest Human Being functioning in the Give mode, is deactivated and laid on its side too.

The Giver moves any unmasked and upright Human Beings 140, or any forest spirit 152, 162, 172, 182, with the objective of returning trees back to the play area 110 and getting all 4 Human Beings 140 together eye-to-eye to form the pyramid. The die roll displayed represents the Opportunity number, or number of squares the Giver can move unmasked and upright Human Beings 140 or forest spirits 152, 162, 172, 182 horizontally and/or vertically, but not diagonally. The un-masked Human Beings 140 must face the same direction at the end of a move as they do at the start, unless a move is used to turn the un-masked Human Being 140. Moving an un-masked Human Being 140 through or onto a square occupied by a tree displaces the tree onto the square from which the un-masked Human Being 140 moved from. Moving an un-masked Human Being 140 onto a square occupied by a Human Being 140 or a forest spirit 152, 162, 172, 182, whether upright or deactivated, displaces the playing piece to the square from which the un-masked Human Being 140 moved from. Each square moved costs one digit of the Opportunity number.

The Giver can move any un-masked Human Being 140 next to another un-masked Human Being 140 in an eye-to-eye configuration, which enables the Giver to replace trees previously removed from the play area 110. When two un-masked Human Beings 140 see eye-to-eye, the Giver can replace one tree for any remaining moves left from the Opportunity number. Preferably, a tree can be returned to any square in the play area 110 as long as the replaced tree touches another tree of its type or its forest spirit. Alternatively, a tree can be returned to any square within the quadrant of the play area 110 that the tree was originally placed in start the game. Deactivated forest spirits, that is forest spirits that have been laid down, can be restored by replacing a tree corresponding to the forest spirit, such as a palm tree 150 for the palm forest spirit 152, next to the deactivated forest spirit. When a replaced tree is placed next to the deactivated forest spirit, both the deactivated forest spirit and the Human Being that was laid down when the forest spirit was laid down are set upright.

In the preferred embodiment, trees can be replaced in any order or combination. For example, say 3 trees can be replaced. The replaced trees can be all palm trees, or one deciduous tree and two coniferous trees.

An exemplary turn for the Giver follows. On this turn the number 5 was thrown. An un-masked Human Being 140 acting in Give mode moves 3 squares to join eye-to-eye with another un-masked Human Being 140. Moving 3 squares uses 3 counts of the number thrown, leaving 2 moves left to play. Since two un-masked Human Beings 140 see eye-to-eye, two moves can be used to replace two previously removed trees. Replacing the trees uses two count of the die. If at least one of the trees replaced are placed adjacent a deactivated forest spirit, where the deactivated forest spirit corresponds to the same forest as the replaced tree, then in the preferred embodiment, the deactivated forest spirit, and the deactivated Human Being that was laid down when the forest spirit was laid down, are restored to the upright position. Restoring the deactivated forest spirit and the deactivated Human Being does not cost a move in the preferred embodiment. However, in the alternative embodiment where restoring a deactivated forest spirit does cost a move, then the deactivated forest spirit must either wait to be restored unit the next move of the Giver, or one of the previous moves to replace a tree can be used to restore the deactivated forest spirit.

Due to the possible orientations of the un-masked Human Being 140, adjacent un-masked Human Beings 140 do not necessarily see eye-to-eye. For example, if a northeast facing un-masked Human Being 140 is placed to the east (right hand side) of a northwest facing un-masked Human Being 140, then these two un-masked Human Beings 140 are not seeing eye-to-eye. They have their backs turned to each other. In order to position the two un-masked Human Beings 140 eye-to-eye, use a move to rotate one of the two un-masked Human Beings 140 by 90-degrees. Each 90-degree turn uses one move of the Opportunity number.

The Giver can also move a deactivated forest spirit next to a tree of its own forest that is still in the play area 110. Each square moved by the deactivated forest spirit uses one digit of the Opportunity number. When the deactivated forest spirit is moved to touch the tree from its forest, the deactivated forest spirit and the Human Being that was laid down with the deactivated forest spirit are set upright, at no extra cost. The Giver can use any combination of the aforementioned moves within a given turn.

In an alternative embodiment, when two un-masked Human Beings 140 see eye-to-eye, a quarter of the trees previously removed from the play area 110 by the Taker are replaced. Round down to the nearest whole number when calculating the number of trees to replace. In this alternative case, replacing a quarter of the forest uses one move from the Opportunity number. Any tree replaced adjacent a deactivated forest spirit reactivates the deactivated forest spirit, which uses one move from the Opportunity number. When three un-masked Human Beings 140 see eye-to-eye, one-half of the trees previously removed from the play area 110 are replaced, in this alternative embodiment.

An un-masked Human Being, that is a human being functioning in the Giver mode, displaces trees in its path. The displaced trees are placed in the empty square from which the un-masked Human Being 140 moved from, and the displaced tree remains there until the tree is subsequently taken by a masked Human Being 140 or displaced again by another masked Human Being 140.

The life of the human being, the forest spirit, and the forest are all dependent upon one another. The forest spirit cannot survive if there are no trees. The un-masked Human Being cannot survive if there is no forest spirit near it. The trees cannot survive if there are no Human Beings 140 seeing eye-to-eye to replant them.

To restore a forest spirit, at least one tree originally encircling the forest spirit must be replaced. The only way trees can be replaced is when two or three un-masked Human Being 140 see eye-to-eye. When there are at least two masked Human Beings joined eye-to-eye, remaining moves of the Opportunity number can be used to replace trees.

When three un-masked Human Beings 140 see eye-to-eye, the masked Human Being 140 in the Taker mode can be pulled into the three un-masked Human Beings 140 to see eye-to-eye, thereby forming a pyramid. To accomplish this move, the Opportunity number available must be equal to or greater than the number of squares necessary for the move. In the preferred embodiment, the Giver can only move the masked Human Being 140 when the three un-masked Human Beings 140 already see eye-to-eye. The Giver wins by forming the pyramid.

Figure 3:
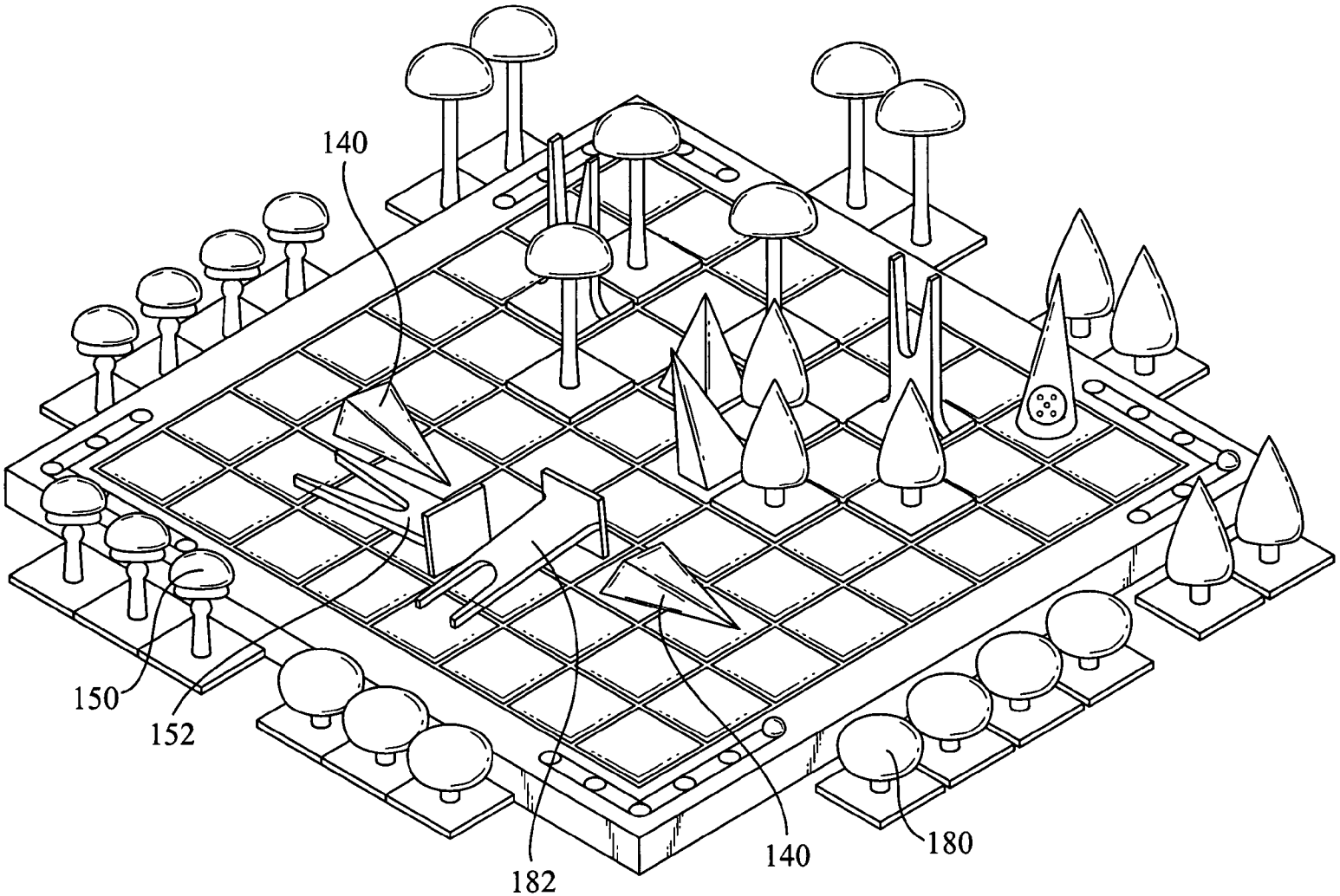
FIG. 3 illustrates an exemplary game pieces configuration in which the Giver wins the game.

FIG. 3 illustrates an exemplary game pieces configuration in which the Giver wins the game. As illustrated in FIG. 3, there is at least one palm tree 150, rainforest tree 160, coniferous tree 170, and deciduous tree 180 standing from each of the four forests. Furthermore, each of the four forest spirits 152, 162, 172, 182 is touching one of the trees of its corresponding forest. As such, each of the four Human Beings 140 is also standing. Finally, the four Human Beings 140 are adjacently positioned so that each of the four pieces touches each other, and each of the four Human Beings 140 see eye-to-eye, thereby forming the pyramid.

The Taker wins by taking all seven trees of two forests. When two forests are completely removed, the two corresponding forest spirits are laid down, as are two un-masked Human Beings. Since only one un-masked human being remains upright, the Taker has effectively blocked the last upright un-masked Human Being from seeing eye-to-eye with another un-masked Human Being eye-to-eye. Therefore, the Giver is not able to restore any trees.

Figure 4:
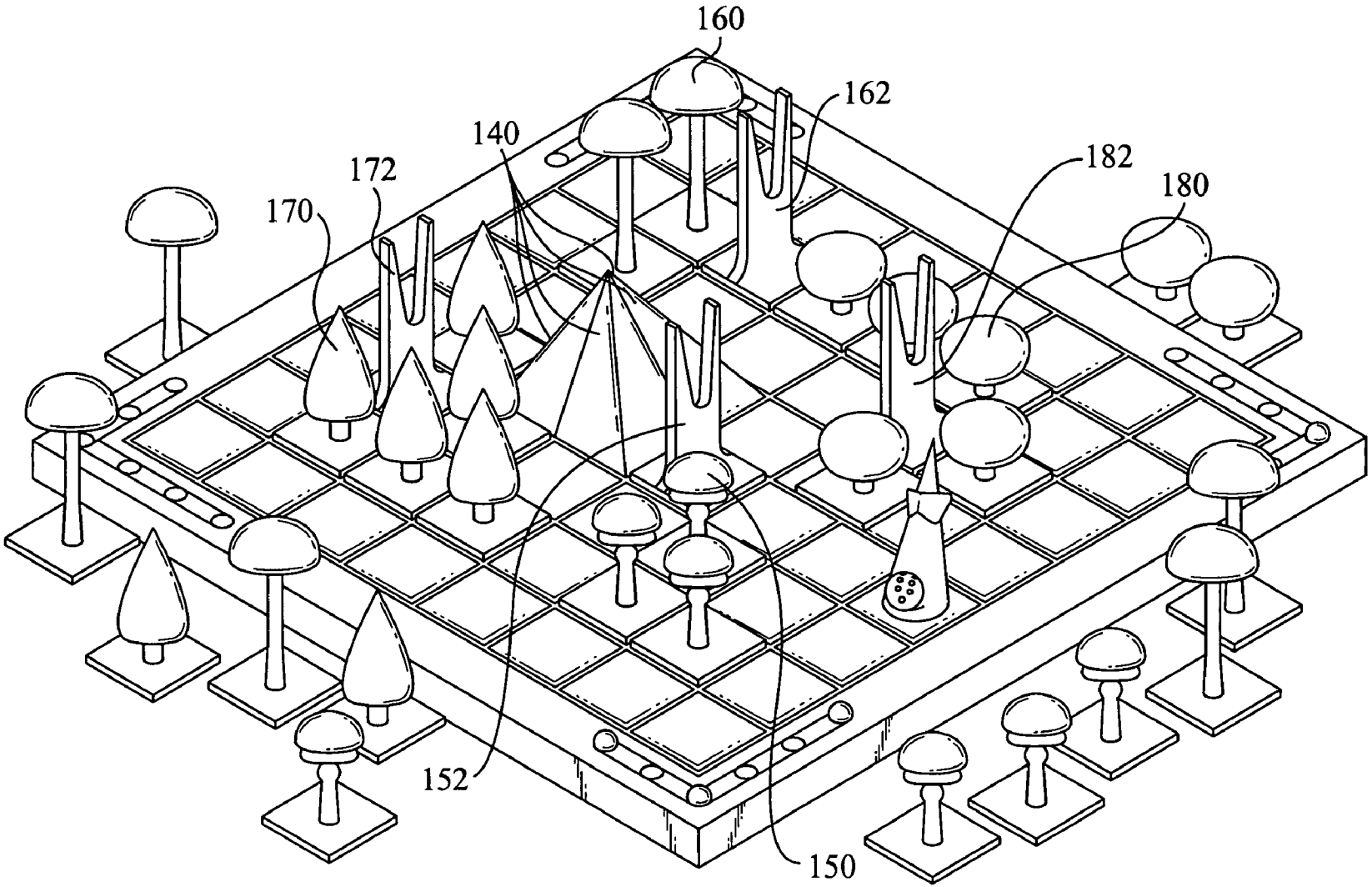
FIG. 4 illustrates an exemplary game pieces configuration in which the Taker wins the game.

FIG. 4 illustrates an exemplary game pieces configuration in which the Taker wins the game. As illustrated in FIG. 4, all seven palm trees 150 are taken off the board. As such, the palm forest spirit 152 is laid down and accordingly, the nearest Human Being 140 to the deactivated palm forest spirit 152 is also laid down. Also illustrated in FIG. 4, all seven deciduous trees 180 are taken off the board. As such, the deciduous forest spirit 182 is laid down and accordingly, the nearest Human Being 140 to the deactivated deciduous forest spirit 182 is also laid down. This leaves only one un-masked human being 140 still standing. Since it requires two un-masked Human Beings 140 to see eye-to-eye and replace taken trees, it is not possible to replace any of the taken trees and therefore the Taker wins.

In a second method of playing the game, the play is the same as that described above in relation to the first method, except that the players switch modes every round. In this second method, both players try to complete the pyramid during their turn in Giver mode, and stop the other player from forming the pyramid during their turn in the Taker mode.

In a third method of playing the game, 4 players play, where each player selects a specific Human Being 140. Play is the same as that described above in relation to the first method of play, with the exception that each player can only move their selected Human Being 140. One player plays alone in the Taker mode against the other three players cooperating committee-style in the Giver mode. Players roles change, from Taker mode to Giver mode, according to the movement of the Opportunity token 130 and the Human Being 140 that wears the mask.

In a fourth method of playing the game, one player plays both modes in turn, according to the rules described above in relation to the first method of play. In this fourth method of playing, the player must abstract themselves to act out both roles in turn.

In a fifth method of playing the game, a series of games is played between two or more players, where players take turns in both the Take and the Give modes, and compete to harvest the highest number of trees. The agenda of the Taker is to score points by harvesting, or taking, as many trees as possible from the play area 110 before the Giver completes the pyramid to end the game. The Taker allows the Giver to replace trees and then takes them again, building the Taker's score as high as possible. The agenda of the Giver is to minimize the harvest of the Taker by forming the pyramid as fast as possible. The Giver does not have to replace trees for every available Opportunity move. Play continues with the beginning of the second game where players switch roles. Now the Taker assumes the Giver role, and vice versa. The player with the greatest harvest wins.

At the outer corner of each quadrant of the game board 100, there is a score counter 190 (FIG. 1). Each score counter preferably includes seven recesses that correspond to the trees of the forest near it. Counting from left to right in a counter-clockwise direction, an object is placed in a recess of the score counter 190, to denote the number of trees taken from the corresponding nearby forest. When the ball reaches the seventh recess, a ring is placed around the first recess to denote one forest of trees taken by the Taker. One ring equals one forest. As more trees are harvested, counting the trees taken continues to move the ball through the recesses again to the seventh recess, whereupon the ring is placed around the second recess denoting two forests taken. Forests, as multiples of seven trees, are recorded in this manner. At the end of each game, the forests and trees of the four score counters 190 are totaled as the score for the Taker. Any number of games can played as determined by the players. After each player has taken the same number of turns as Taker, the players compare scores of their harvests to determine the winner. The counting of harvested trees can be cumulative over a series of games or can be a single game with a highest score from that series.

Figure 5:
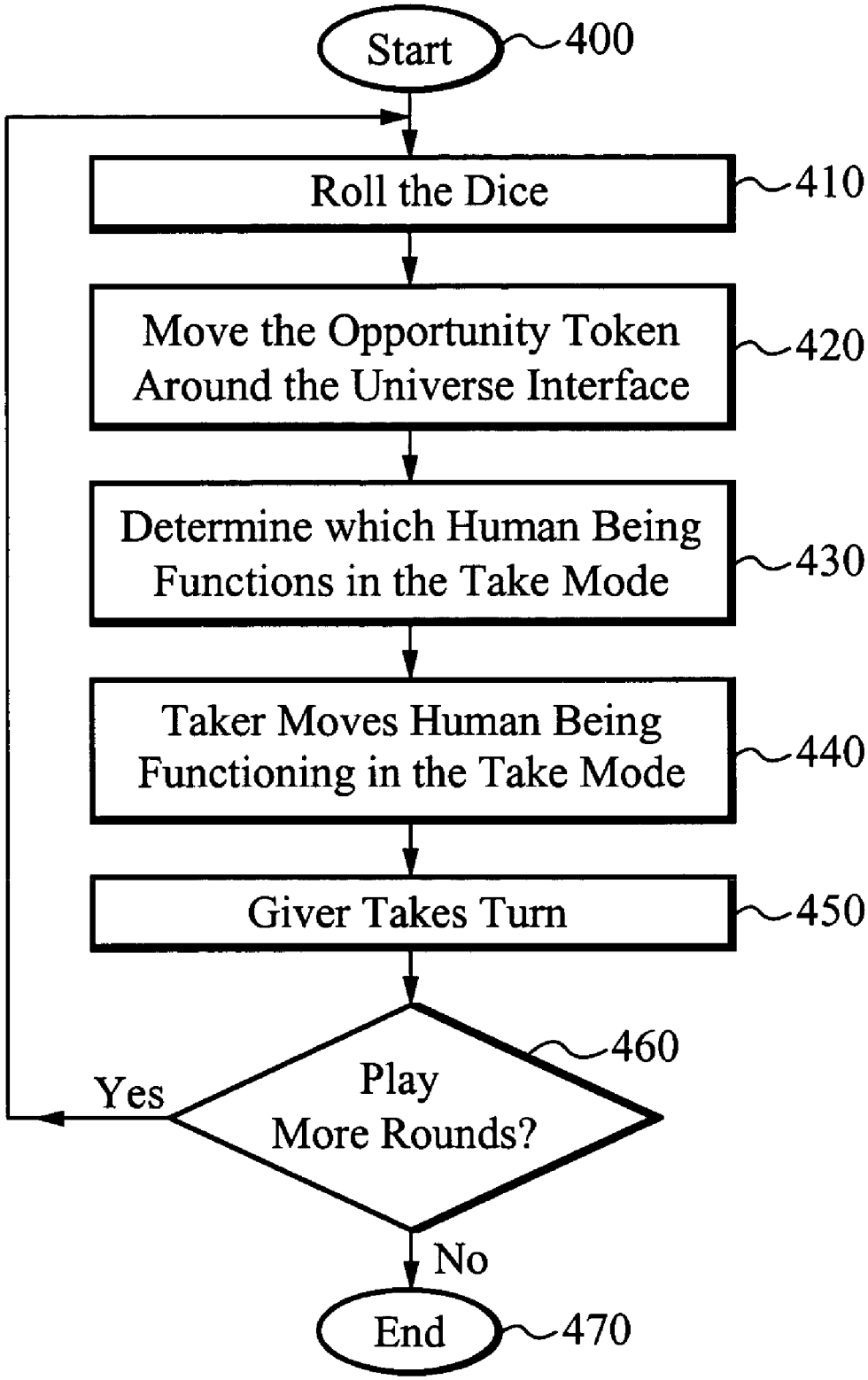
FIG. 5 illustrates a preferred method of playing the board game of the present invention.

FIG. 5 illustrates a preferred method of playing the board game of the present invention described above. The method starts at the step 400. At the step 410, the die is rolled. At the step 420, the Opportunity token 130 is moved around the Universe Interface 120 the number of squares rolled on the die at the step 410. In the preferred embodiment. The Opportunity token 130 is moved clockwise about the Universe Interface 120. At the step 430, it is determined which of the Human Being 140 game pieces is to function in the take mode. The Human Being 140 game piece closest to the circumstance changer is the Human Being 140 game piece that functions according to the take mode. If two or more Human Being 140 game pieces are the same distance to the circumstance changer, then the Taker determines which of the equidistant Human Being 140 game pieces is to function in the take mode. If it is a round other than the first round, and one of the Human Being 140 game pieces is the Human Being 140 game piece that functioned in the Taker mode during the previous round, then the same Human Being 140 game piece is to function in the Taker mode for the current round. At the step 440, the Taker moves the Human Being 140 game piece functioning in the take mode. The number of moves available to the Taker is equal to the number rolled in the step 410. At the step 450, the Giver makes a number of moves equal to the number rolled in the step 410. The Giver makes a move by moving any one of the three Human Beings 140 not functioning in the take mode, moving any one of the forest spirits, replacing previously taken trees onto the play area of the game board, moving the one Human Being functioning in the take mode if the other three Human Beings 140 are already seeing eye-to-eye and there are enough moves to do so, or any combination thereof.

At the step 460, it is determined if additional rounds are to be played. If at the step 440, the Taker successfully took all trees from two different forest, then the game ends at the step 470. If at the step 450, the Giver successfully positioned all four Human Being game pieces into a pyramid configuration, then the game ends at the step. Otherwise, game play continues at the step 410, where the die is rolled again. It is understood that alternative steps can be added, changed, or removed according to alternative methods of game play. For example, if two players are playing where they alternate each round from being the Taker to being the Giver, and vice versa, then as each new round begins at the step 410, the roll of Giver and Taker are switched by the two players.

In an alternative embodiment, the board game and method of playing thereof described above is configured as a computer game which is played on a computer. The game board is displayed on the computer display and one, or more, users, uses the user interface, such as the keyboard and mouse, to enter the moves. It is understood that multiple players can play using either a single computer, or via multiple computers coupled together via a conventional computer network, such as the Internet.

III. Construction of the Game Board

Figure 6:
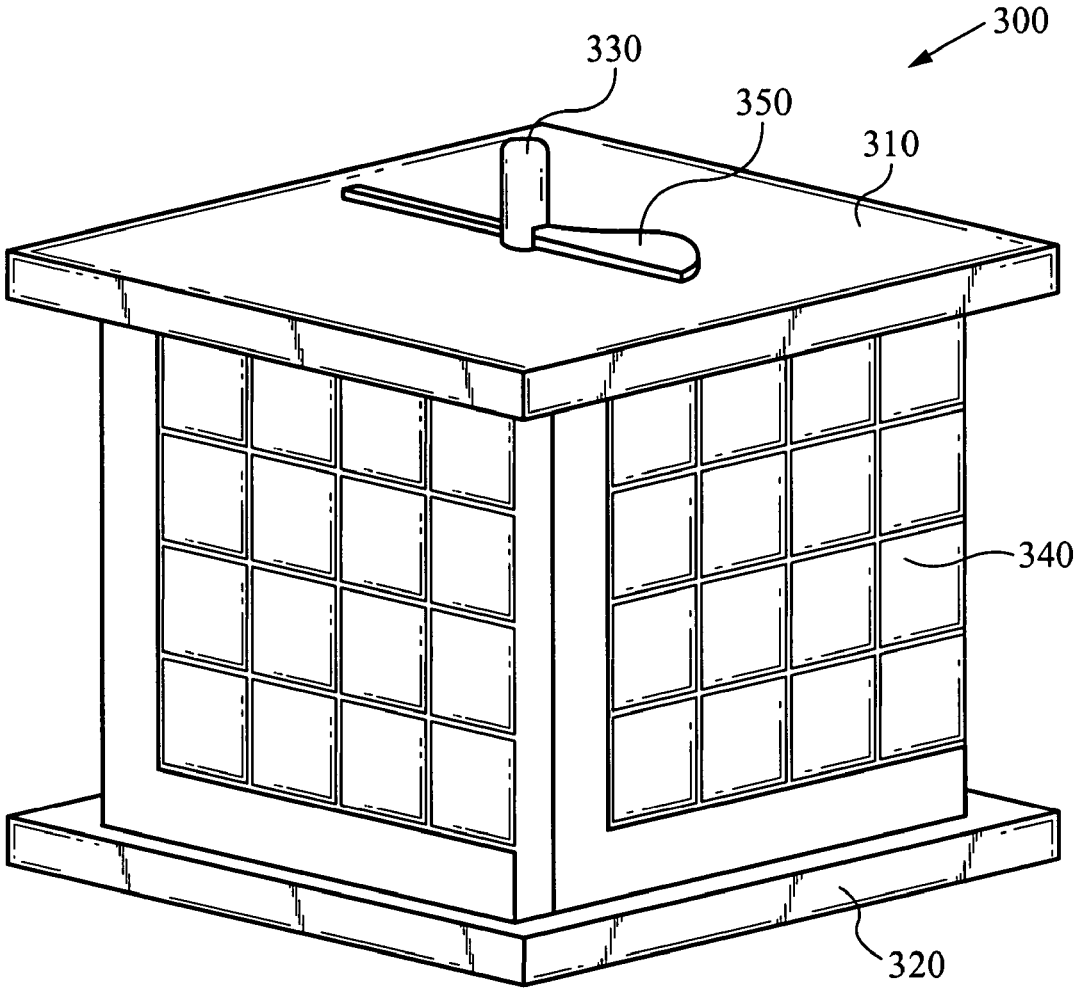
FIG. 6 illustrates a perspective view of a game box used to store the board game of the present invention.
Figure 7:
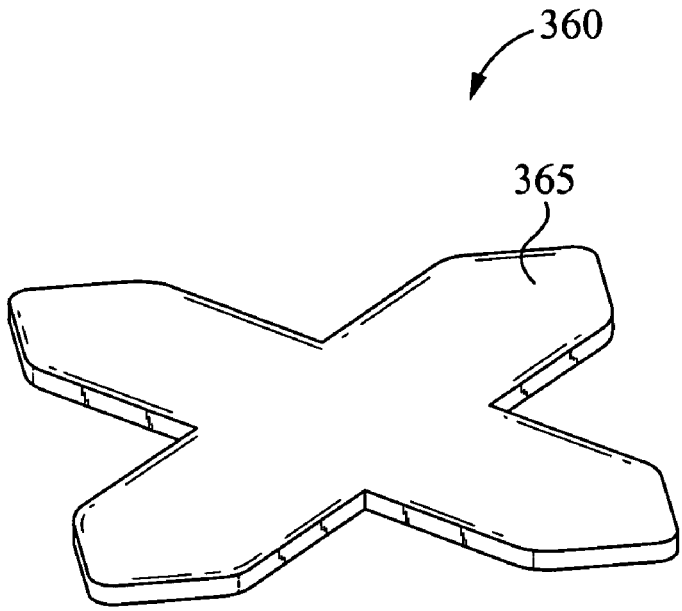
FIG. 7 illustrates an X-lock used in assembling the game board.
Figure 8:
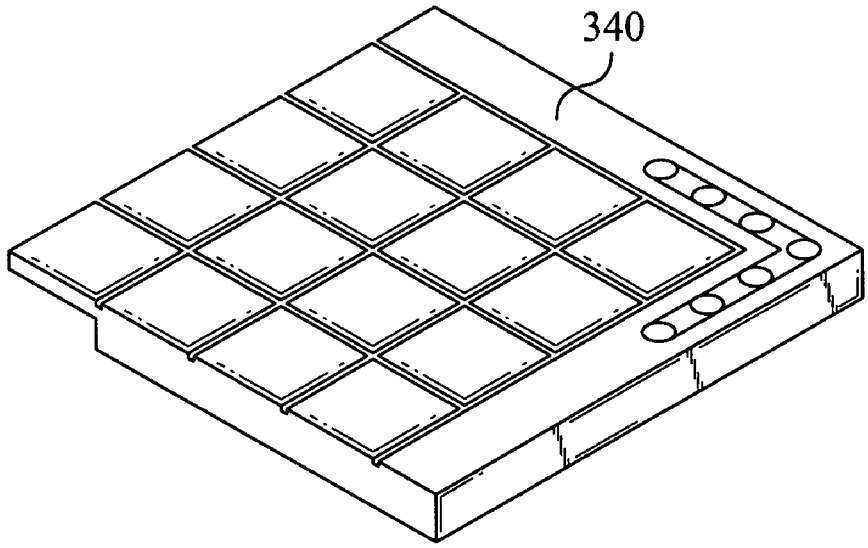
FIG. 8 illustrates a top down perspective view of one of the game board pieces.
Figure 9:
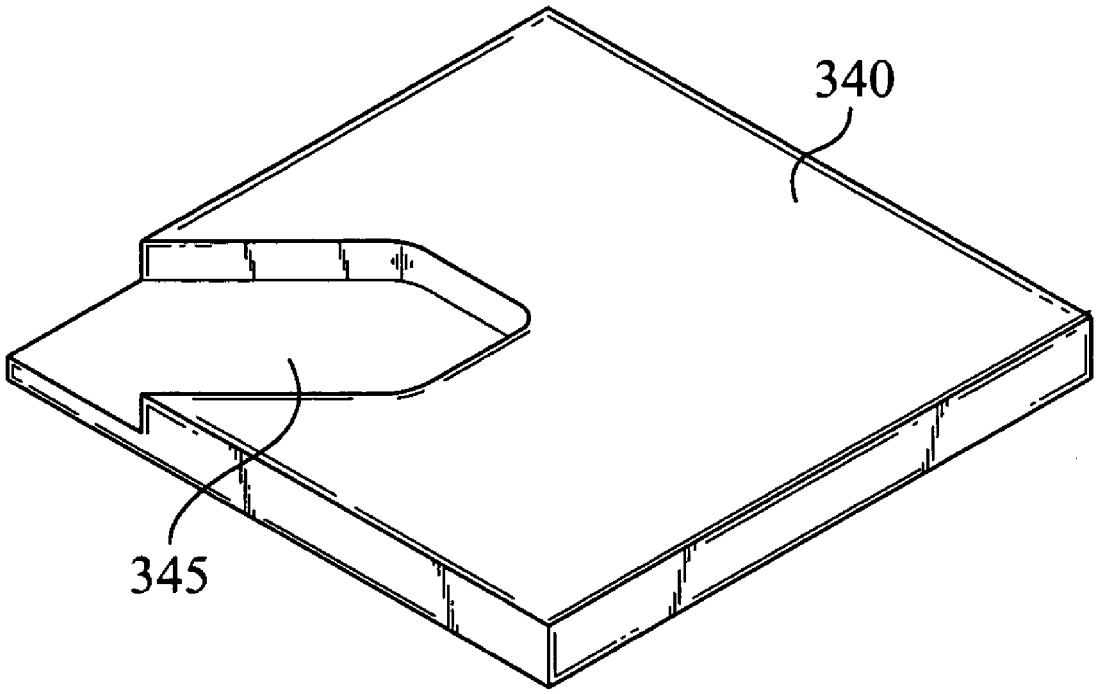
FIG. 9 illustrates a bottom up perspective view of one of the game board pieces.

FIG. 6 illustrates a perspective view of a game box 300 used to store the board game of the present invention. The game box 300 includes the component pieces of the game board 100 (FIG. 1). Disassembled, the game board 100 includes four square pieces 340 (FIG. 8), each piece 340 forms a side of the game box 300, see FIG. 6. A top perspective view of one such piece 340 is illustrated in FIG. 8. A bottom perspective view of the piece 340 is illustrated in FIG. 9. Included in the bottom of each piece 340 is a recessed area 345. The recessed area 345 is shaped according to a limb of an X-lock 360, which is illustrated in FIG. 7. The X-lock 360 is preferably shaped as an X, but other shapes can also be used. The X-lock 360 preferably includes beveled edges. Each limb 365 of the X-lock 360 corresponds to the recessed area 345 of a board piece 340. In this manner, the limb 365 slides into the recessed area 345. Each board piece 340 slides onto the X-lock 360. The four pieces 340 preferably meet at the center of the X-lock 360 to create the game board 100.

Figure 11:
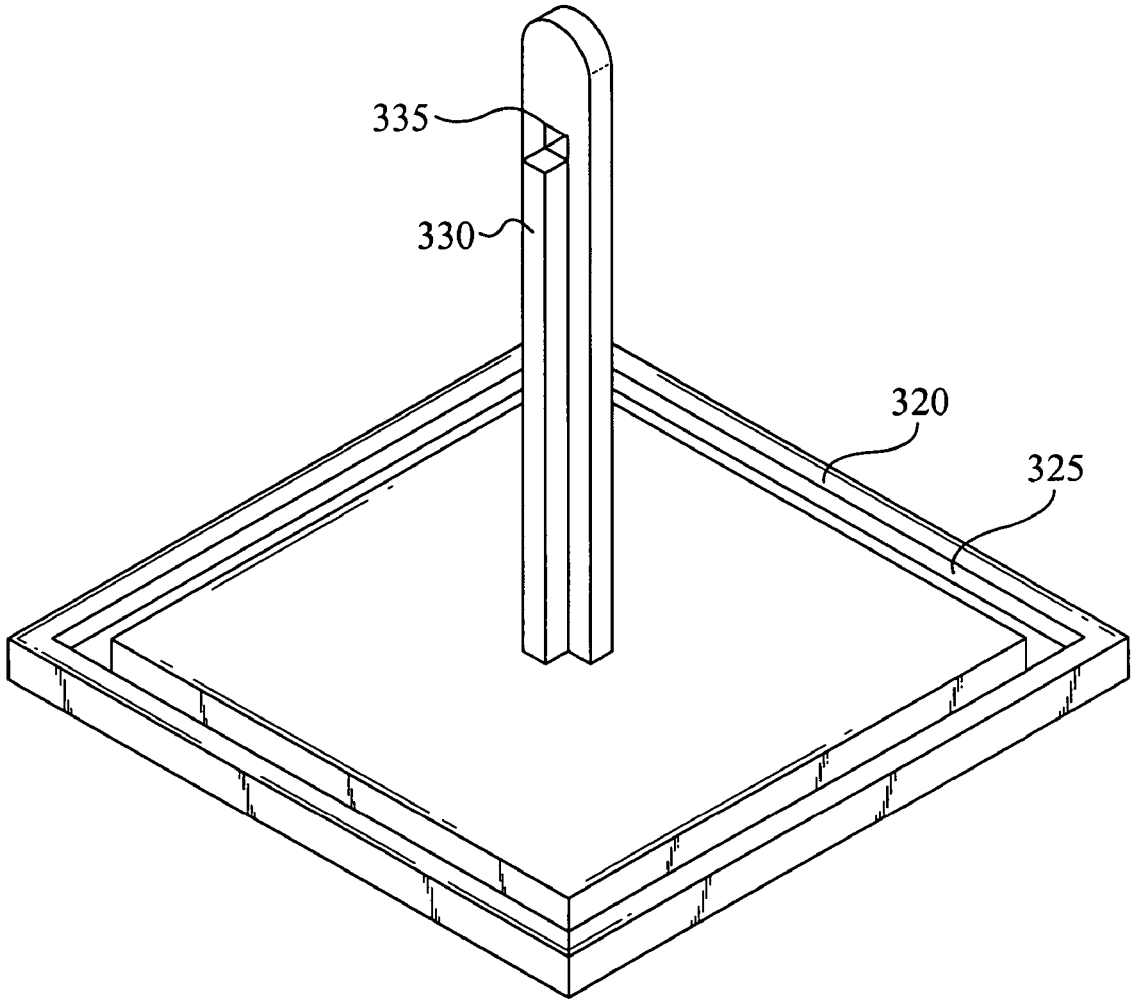
FIG. 11 illustrates a top down perspective view of the assembled bottom piece and X-rod.

The game box 300 also includes a bottom piece 320. A top perspective view of the bottom piece 320 is illustrated in FIG. 11. The bottom piece 320 includes a center hole into which an X-rod 330 fits, the X-rod 330 extending perpendicular to the bottom piece 320. The bottom piece 320 also includes four outer grooves 325 running parallel to and just inside of the outer edge of the bottom piece 320. Each one of the four board pieces 340 fits into one of the four grooves 325 to form the four sides of the game box 300.

Figure 10:
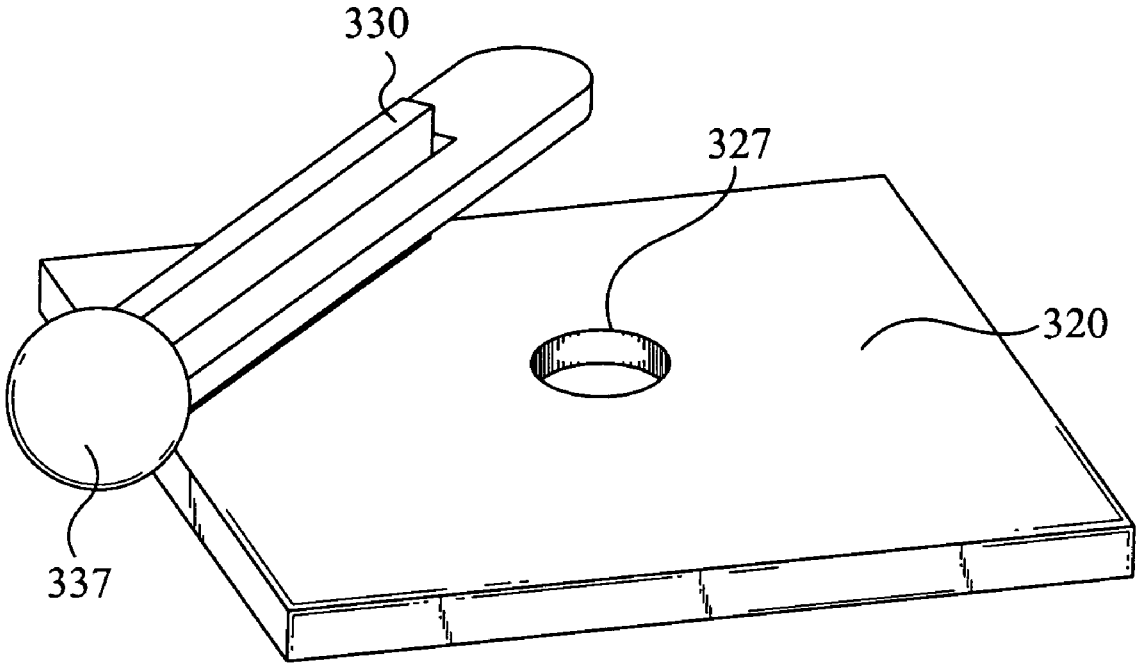
FIG. 10 illustrates a bottom up perspective view of the bottom piece and the X-rod.

A bottom perspective view of the bottom piece 320 and the X-rod 330 are illustrated in FIG. 10. As the X-rod 330 is placed through the center hole of the bottom piece 320, the X-rod 330 grips the bottom piece 320 by means of a flange 337 that fits into a recess 327 in the bottom side of the bottom piece 340.

A key 350 (FIG. 6) passes through a slot 335 (FIG. 11) in the X-rod 330 located at the level the X-rod 330 protrudes above a lid 310 (FIG. 6) of the game box 300. The lid 310 is locked in place by preferably sliding the key 350 in the slot 335 and then turning it, thereby securing the lid 310 to the four side pieces 340, and forming the completed game box 300. Before securing the lid into place, the game pieces and the X-lock 360 can be placed inside the box 300 for storage. The X-lock 360 preferably includes a center hole through which the X-rod 330 can pass. The X-lock 360 is placed in the game box 300 by sliding the X-lock 360 down the X-rod 330 into the game box 300. Preferable, the X-lock 360 slides to the top surface of the bottom piece 320.

The game board 100 can also be set up for easy movement. The game board 100 is pieced together using the four board pieces 340 and the X-lock 360 as described above, except the four board pieces 340 are not pushed all the way to the center of the X-lock 360. Enough space is left between the four board pieces 340 to see the center X-shaped hole in the center of the X-lock 360. Separately from the board pieces 340 and the X-lock 360, the lid 310 is aligned over the bottom portion 320 such that the X-rod 330 can be pushed through the center holes of each, aligning the flange 337 of the X-rod 330 into the recess 327 of the bottom piece 320. Lift the board set including the X-lock 360 and the four board pieces 340 over the vertical X-rod 330 and position the X-shaped hole in the center of the X-lock 360 over the X-rod 330. Slide the board set down the X-rod 330 until the board set rests on the lid 310. The X-rod 330 can now be used as a handle to pick up the game set and move it around.

The present invention has been described in terms of specific embodiments incorporating details to facilitate the understanding of principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

I claim:

1. A board game comprising:

a. a game board configured as a grid, the grid comprising:

i. an inner play area comprising an inner portion of the grid; and ii. an outer play area comprising an outer portion of the grid; and b. a plurality of game pieces comprising:

i. a plurality of first game pieces designated by a first type each having at least one upstanding face including a protrusion extending from the upstanding face or an indentation into the upstanding face, wherein each one of the first game pieces is configured to come in face to face contact with at least one of the other first game pieces to form new game piece structures, further wherein the indentation from the upstanding face of one first game piece is configured to receive the protrusion from the upstanding face of the other first game piece, thereby interlocking the first game pieces;

ii. a plurality of second game pieces designated by a second type;

iii. a plurality of third game pieces designated by a third type;

iv. a plurality of fourth game pieces designated by a fourth type;

v. a plurality of fifth game pieces designated by a fifth type; and vi. a plurality of sixth game pieces designated by a sixth type, wherein a first one of the sixth game pieces is associated with each one of the plurality of second game pieces, a second one of the sixth game pieces is associated with each one of the plurality of third game pieces, a third one of the sixth game pieces is associated with each one of the plurality of fourth game pieces, and a fourth one of the sixth game pieces is associated with each one of the plurality of fifth game pieces.

2. The board game of claim 1 wherein each type of game piece is designated by a specific shape.

3. The board game of claim 2 wherein the plurality of second game pieces is designated as a first type of tree, the plurality of third game pieces is designated as a second type of tree, the plurality of fourth game pieces is designated as a third type of tree, and the plurality of fourth game pieces is designated as a fourth type of tree.

4. The board game of claim 1 wherein the grid comprises an 8×8array of squares, the inner play area comprises an inner 6×6 array of the squares, and the outer play area comprises an outer perimeter of squares surrounding the inner 6×6 array.

5. The board game of claim 1 further comprising randomizing means to determine movement of the plurality of game pieces.

6. The board game of claim 1 wherein the first one of the sixth set is designated by a first color, the second one of the sixth set is designated by a second color, the third one of the sixth set is designated by a third color, and the fourth one of the sixth set is designated by a fourth color.

7. The board game of claim 1, wherein each one of the plurality of first game pieces comprises one-quarter of a pyramid including two flat vertical sides and two flat sloped sides.

8. A board game comprising:

a. a game board configured as a grid including a plurality of squares, the grid comprising:

i. an inner play area comprising an inner portion of the grid; and ii. an outer play area comprising an outer portion of the grid; and b. a plurality of game pieces comprising:

i. a plurality of first game pieces designated by a first type each having two upstanding faces, each face having a full-height of the first game piece, wherein each one of the first game pieces is configured to come in face to face contact with at least one of the other first game pieces to form new game piece structures, further wherein when two or more first game pieces are in face to face contact the resulting new game piece structure has a dimension that is longer than a square on the grid, further wherein each one of the plurality of first game pieces comprises one-quarter of a pyramid including two flat vertical upstanding faces and two flat sloped sides;

ii. a plurality of second game pieces designated by a second type;

iii. a plurality of third game pieces designated by a third type;

iv. a plurality of fourth game pieces designated by a fourth type;

v. a plurality of fifth game pieces designated by a fifth type; and vi. a plurality of sixth game pieces designated by a sixth type, wherein a first one of the sixth game pieces is associated with each one of the plurality of second game pieces, a second one of the sixth game pieces is associated with each one of the plurality of third game pieces, a third one of the sixth game pieces is associated with each one of the plurality of fourth game pieces, and a fourth one of the sixth game pieces is associated with each one of the plurality of fifth game pieces.

9. The board game of claim 8 wherein each type of game piece is designated by a specific shape.

10. The board game of claim 8 wherein the grid comprises an 8×8array of squares, the inner play area comprises an inner 6×6 array of the squares, and the outer play area comprises an outer perimeter of squares surrounding the inner 6×6 array.

11. The board game of claim 8 further comprising randomizing means to determine movement of the plurality of game pieces.

12. The board game of claim 8 wherein the plurality of second game pieces is designated as a first type of tree, the plurality of third game pieces is designated as a second type of tree, the plurality of fourth game pieces is designated as a third type of tree, and the plurality of fourth game pieces is designated as a fourth type of tree.

13. The board game of claim 8 wherein the first one of the sixth set is designated by a first color, the second one of the sixth set is designated by a second color, the third one of the sixth set is designated by a third color, and the fourth one of the sixth set is designated by a fourth color.

* * * * *